United States Patent [19]

Darcangelo et al.

[11] Patent Number: 4,760,672

[45] Date of Patent: Aug. 2, 1988

[54] SIMULTANEOUSLY GRINDING AND POLISHING PREFORMS FOR OPTICAL LENSES

[75] Inventors: Charles M. Darcangelo, Corning; Robert M. Hujar, Painted Post; Paul S. Schmitt, Corning; Harold G. Shafer, Jr., Rock Stream, all of N.Y.

[73] Assignee: Corning Glass Works, Corning, N.Y.

[21] Appl. No.: 940,275

[22] Filed: Dec. 10, 1986

[51] Int. Cl.[4] ..... B24B 13/00

[52] U.S. Cl. ..... 51/284 R; 51/105 LG; 51/98.5; 51/125.5; 51/165.78; 408/129; 409/167

[58] Field of Search ..... 51/96, 97 R, 98.5, 105 LG, 51/123 R, 124 R, 124 L, 125.5, 165.78, 165.79, 165.8, 126, 131.1, 58, 284 R; 408/129; 409/167, 904; 384/12, 118

[56] References Cited

U.S. PATENT DOCUMENTS

| | | | |
|---|---|---|---|
| 2,684,272 | 7/1954 | Annen | 384/118 X |
| 2,975,565 | 3/1961 | Phillips | 51/124 L |
| 3,266,854 | 8/1966 | Aller | 384/12 |
| 3,492,764 | 2/1970 | Dalton | 51/284 |
| 4,481,023 | 11/1984 | Marechal et al. | 65/106 |
| 4,589,231 | 5/1986 | Roberts | 51/124 L |
| 4,607,461 | 8/1986 | Adams | 51/165.8 |
| 4,637,168 | 1/1987 | Kotting et al. | 51/165.79 X |

OTHER PUBLICATIONS

Donaldson, R. R., Patterson, S. R. and Thompson, D. C., "Diamond-Machining and Mechanical Inspection of Optical Components", UCRL-86897, Lawrence Livermore National Laboratory, Livermore, CCA, Nov. 13, 1981.

Brehm, P. D., "Making the Most of Precision Machining", Photonics Spectra, Jun. 1982.

*Primary Examiner*—Robert P. Olszewski

*Attorney, Agent, or Firm*—Burton R. Turner; Richard E. Kurtz

[57] ABSTRACT

An optical surface on a glass preform for an optical lens is simultaneously ground and polished. A glass blank is rotated by a work spindle mounted in an air bearing. A resin bonded diamond cutting ring is rotated by a tool spindle mounted in an air bearing. The axis of the tool spindle is set at an angle with respect to the axis of the work spindle with the edge of the cutting ring being centered on the axis of rotation of the blank. One of the spindles is moved linearly with respect to the other to move the cutting ring into engagement with the blank for grinding a precisely shaped, polished optical surface thereon. The spindles are mounted on a table and a driving motor for the linear drive is remote from the table to isolate the spindles from the vibration of the motor.

9 Claims, 4 Drawing Sheets

SIMULTANEOUSLY GRINDING AND POLISHING PREFORMS FOR OPTICAL LENSES

BACKGROUND OF THE INVENTION

This invention relates to grinding and polishing of preforms for optical lenses and, more particularly, to performing these operations simultaneously.

The use of high-speed, air-bearing spindles in grinding operations is known. The optimization of speed, stiffness, rotational accuracy, and vibrationless operation can produce surfaces on many materials with roughness values in the fractional microinch range and surface figures of a fraction of a wave. These good results are generally obtained by single-point cutting of plastics and soft metals. See, for example, Donaldson, R. R., Patterson, S. R. and Thompson, D. C., "Diamond-Machining and Mechanical Inspection of Optical Components" UCRL-86897, Lawrence Livermore National Laboratory, Livermore, CCA, Nov. 13, 1981; and Brehm, P. D., "Making the Most of Precision Machining", Photonics Spectra, June 1982.

Precision glass optical elements may be formed in molds having a precise configuration. U.S. Pat. No. 4,481,023-Marechal and Maschmeyer decribes the molding of a glass lens having dimensional tolerances finer than 0.1% and surface figure tolerances finer than 0.2 λ/cm in the visible range of the radiation spectrum.

The molding of aspheric lenses in accordance with the Marechal and Maschmeyer patent requires that a precise preform, or blank, be produced with two polished surfaces. These precise preforms are then pressed in a mold to the final finished form. For example, for small lenses for audio and video players, the preform shape is a bi-convex lens of about 7–14 millimeter diameter. The current process for producing the preform for such lenses uses a grinding process to produce the shape of the preform. Then, conventional lapping and polishing steps produce the required finish on the lens preform.

It is an object of the present invention to produce a ground and polished optical surface on a glass lens preform in a single operation.

It is a further object of the present invention to produce spherical, prolate, and other complex optical surfaces by a grinding and polishing operation.

SUMMARY OF THE INVENTION

In accordance with the present invention, a glass blank for an optical lens is ground and simultaneously polished by rotating the glass blank on a work spindle mounted in an air bearing, rotating a diamond cutting ring on a tool spindle mounted in an air bearing, and moving one of the spindles linearly with respect to the other to move the cutting ring into engagement with the blank. The tool spindle on which the diamond cutting ring is mounted has an axis which is set an an angle with respect to the axis of the work spindle. The angle between the tool spindle axis and the axis of the work spindle is adjusted to change the radius of curvature of the optical surface on the glass blank. To form spherical surfaces, the axis of the tool spindle is angularly offset from, but in the same plane as, the axis of the work spindle.

Further in accordance with the invention, complex optical shapes, such as a prolate preform, are obtained by changing the plane of the axis of rotation of the work spindle with respect to the axis of rotation of the tool spindle.

In accordance with the present invention, an optical polish on a glass preform for an optical lens is obtained by a grinding operation which is free of vibration and spindle runout. This is accomplished by using air bearings and linear air slides that are accurate to a few microinches, and by isolating the grinding from drive motor vibration.

By using the machine and method of the present invention, lenses have been ground with an optical polish of 0.2 microinches AA (Arithmetic Average) or less, and an optical figure of ¼ to several fringes can be achieved. These results were obtained while eliminating two of the three steps of conventional processes of making glass preforms of this type.

The foregoing and other objects, features, and advantages of the invention will be better understood from the following more detailed description and appended claims.

SHORT DESCRIPTION OF THE DRAWINGS

Figure 3:
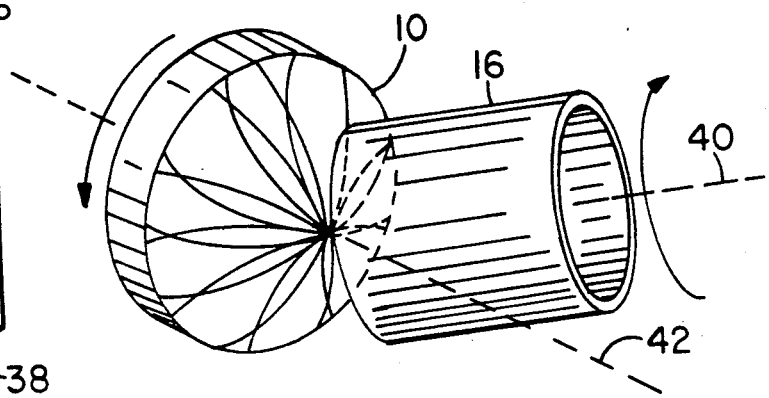
FIG. 3 shows the cutting ring in relation to the glass blank when generating a spherical optical surface.
Figure 3A:
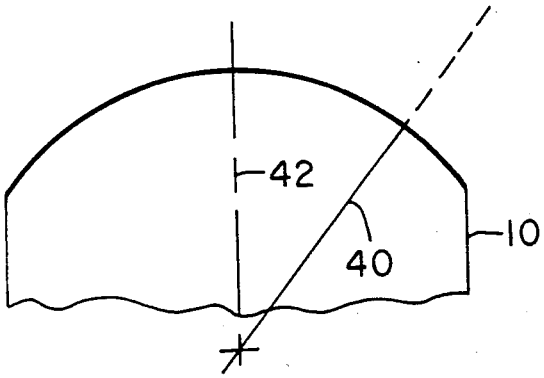
Figure 3B:
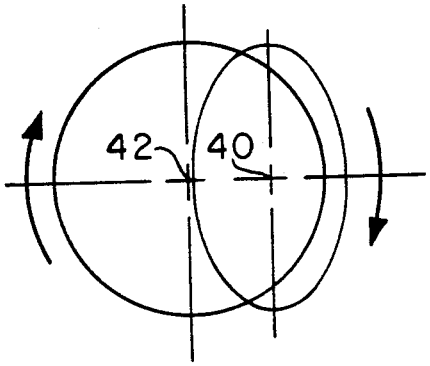
Figure 4:
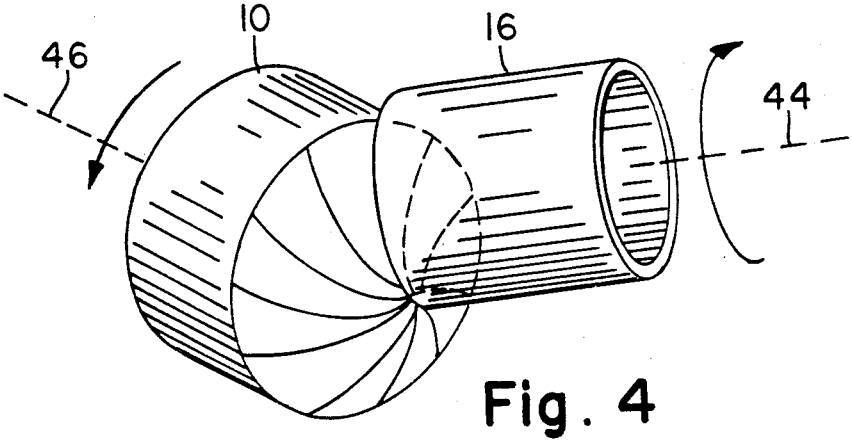
Figure 4A:
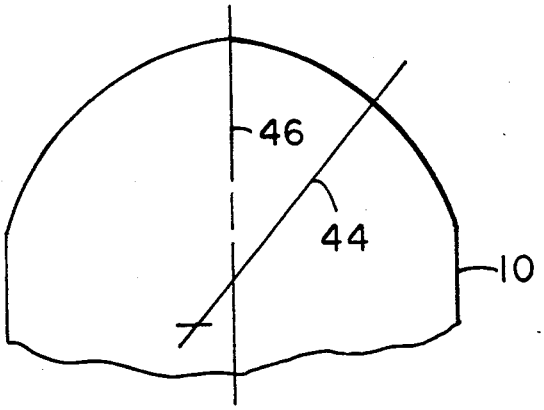
Figure 4B:
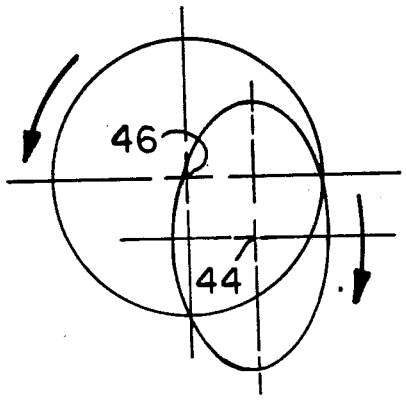
Figure 5:
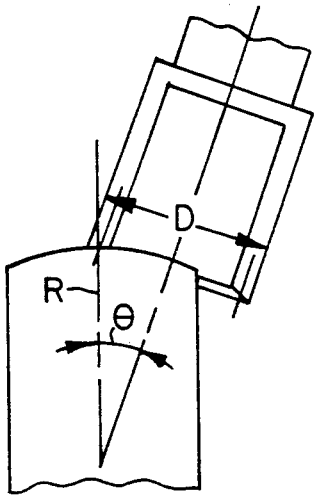
Figure 5A:
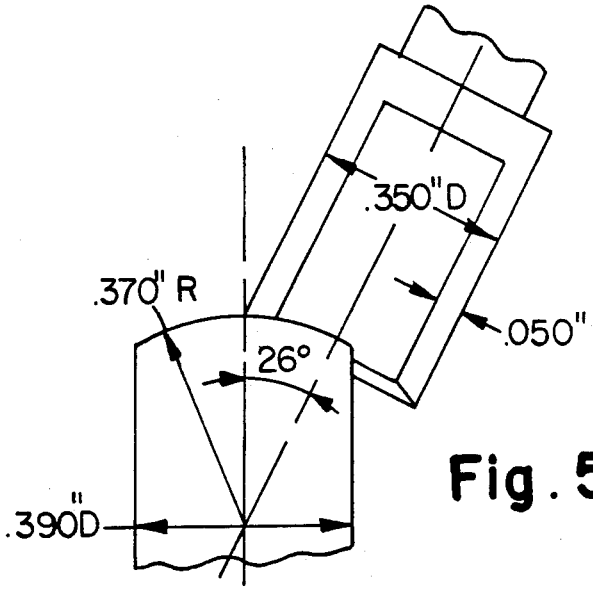
Figure 5B:
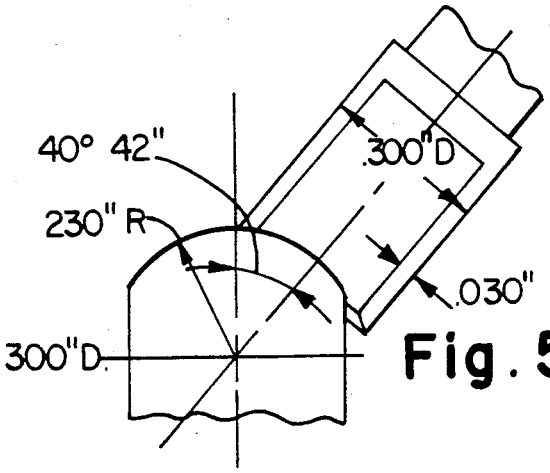
Figure 6:
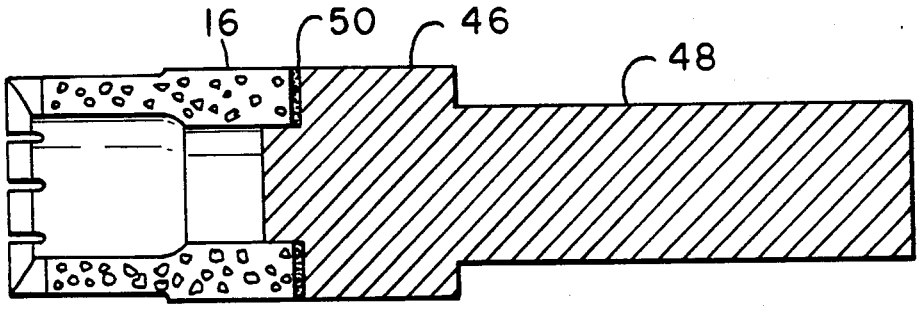

FIG. 3*a* shows a preform with a spherical optical surface;

FIG. 3*b* shows the relationship between the axes of rotation of the blank and cutting ring during generation of a spherical surface;

FIG. 4 shows the relationship between the cutting ring and the blank when generating a prolate optical surface;

FIG. 4*a* shows a prolate optical surface;

FIG. 4*b* shows the relationship between the axes of rotation of the blank and cutting ring during generation of a prolate surface;

FIG. 5 shows the dimensions and relationship between the blank and the cutting ring in generating a spherical optical surface;

FIGS. 5*a* and 5*b* are similar to FIG. 5, but show specific dimensions and relationships for examples of the practice of the invention; and FIG. 6 shows the diamond cutting ring.

DESCRIPTION OF THE PREFERRED EMBODIMENT

Figure 1:
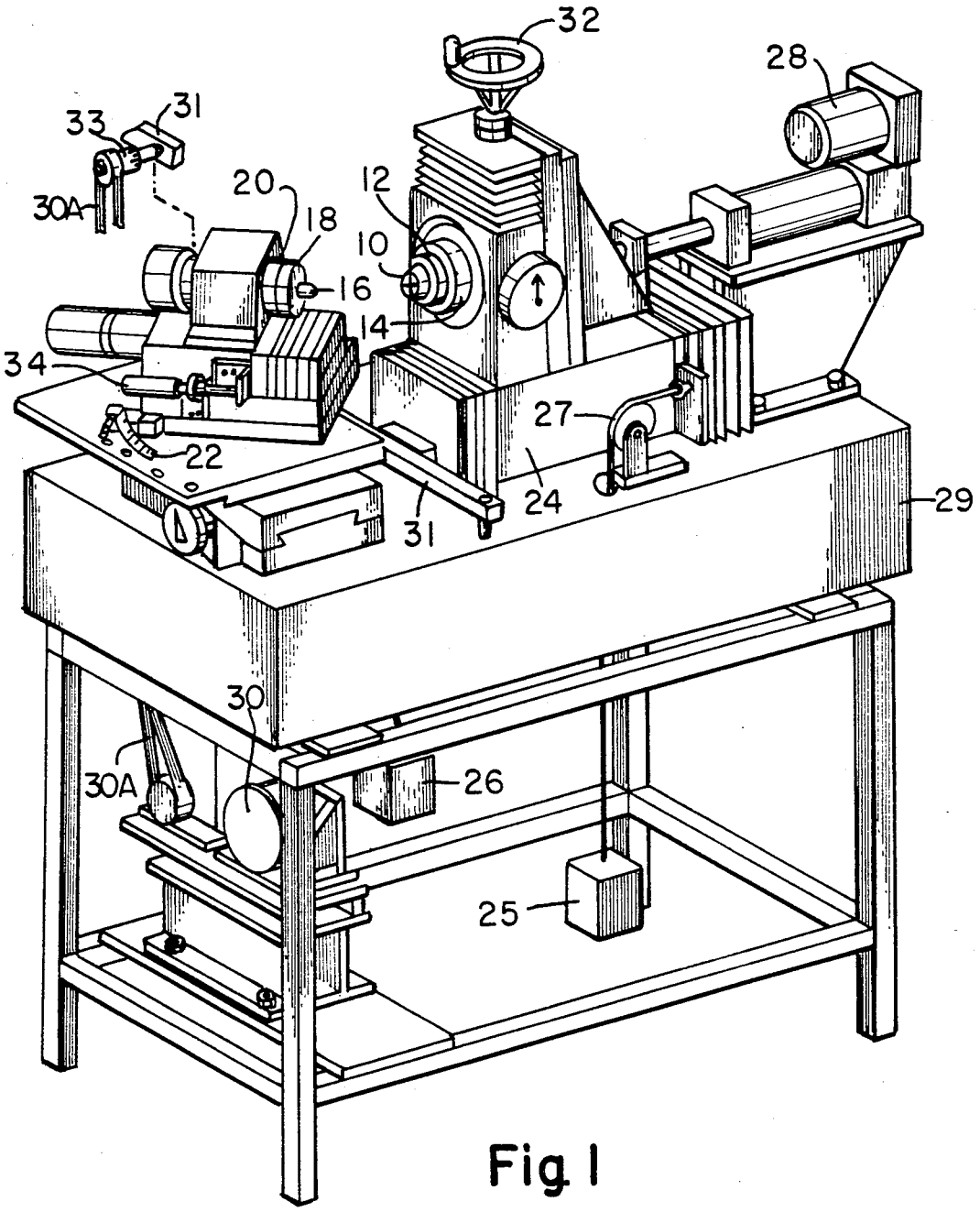
FIG. 1 depicts a machine for making glass preforms in accordance with the present invention.

Referring to FIG. 1, a glass blank 10 for an optical lens is simultaneously ground and polished by rotating blank 10 on a work spindle 12 mounted in an air bearing 14. A diamond cutting ring tool 16 is rotated on a tool spindle 18 which is mounted in an air bearing 20. The axis of the tool spindle 18 is set at an angle with respect to the axis of the work spindle 12. The angle is set by the angular adjusting mechanism 22. The angle is adjustable from 0° to approximately 55° with the larger angles generating optical surfaces having smaller radii of curvature.

Work spindle 12, and its air bearing 14, are moved linearly by an air slide 24. Air slide 24 moves the blank 10 into engagement with the cutting ring 16 to grind a precisely shaped polished optical surface on the blank.

Weights 25 and 26 with attached cables extending over pulleys, such as 27, preload the air slide to bias the work spindle 12 toward the tool spindle 18 with a constant force. An air cylinder 28 is provided to retract the air slide linearly. The air slide 24, on which the work spindle is mounted, is initially biased by the weights 25, 26 against an arm 31. The arm 31 is then moved slowly toward the tool 16 through a linear drive. Motor 30 drives a belt 30A coupled to a micrometer drive 33. The micrometer drive 33 moves the arm 31 toward the tool spindle 18 at a predetermined feed rate. This permits the workpiece 10 to move, by means of the force provided by weights 25 and 26, during a grinding cycle toward the tool 16 and to a final stop position at which grinding is completed. After completion of the grinding, a rest period is provided, commonly referred to as "spark out." During spark out, cutting ring 16 rotates at the same linear position for a period of time to finish the polish of the workpiece. Typically, approximately 10 seconds of rotation in this position is provided.

Work spindle 12 and its air bearing 14, tool spindle 18 and its air bearing 20, and air slide 24 are mounted on a work table 29, which provides a stable support for accurate alignment of these components.

Drive motor 30 is mounted remotely from the table 29. This isolates the spindles from the vibration of the motor to further enhance the polishing which takes place simultaneously with grinding.

In order to change the shape of the optical surface on the glass blank 10, a vertical adjusting mechanism for the work spindle 12 is provided. This includes an adjusting wheel 32 for moving the work spindle 12 vertically. This changes the plane of the axis of rotation of the work spindle with respect to the tool spindle. When the axis of rotation of the work spindle is in the same plane as the axis of rotation of the tool spindle, a spherical optical surface is generated. When the plane of the axis of rotation of the work spindle is displaced vertically with respect to the axis of rotation of the tool spindle, other complex optical shapes, including a prolate shape, are generated.

The cutting edge of the cutting ring 16 is centered on the axis of rotation of the blank 10. In order to precisely make this adjustment, a lateral adjustment mechanism 34 for the tool spindle 18 is provided. For example, after the adjusting wheel 32 is used to change the plane of the axis of rotation of the work spindle 12 with respect to the axis of rotation of the tool spindle 18, lateral adjustment mechanism 34 is used to align the edge of cutting ring 16 with the axis of rotation of the blank 10.

Figure 2:
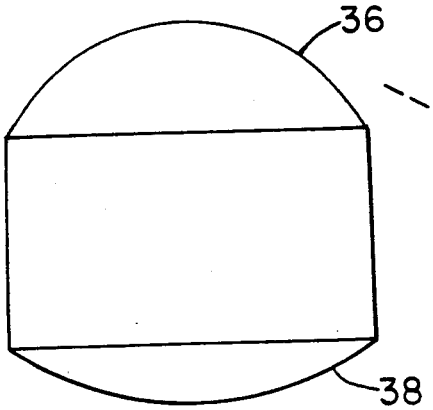
FIG. 2 depicts a preform for an optical lens of the type produced in accordance with the present invention.

FIG. 2 shows a typical preform for a video lens produced in accordance with the present invention. The preform has two precisely ground and polished optical surfaces 36 and 38.

FIG. 3 depicts the relationship between the cutting ring tool 16 and the blank 10 during the grinding and polishing of a spherical optical surface which is shown in FIG. 3*a*. The pattern shown on blank 10 schematicallly represents the surface engagement between the cutting tool and the blank during the generation of a spherical surface. The axis of rotation 40 of cutting ring 16 is in the same plane as the axis of rotation 42 of optical blank 10.

FIG. 3*b* is a schematic illustration showing the axial center line of the preform and that of the tool as being angularly offset but within the same plane. Note that since the tool is at an angle to the preform, it is shown as an elliptical ring which actually represents the active cutting diameter of the tool.

FIG. 4 shows the relationship between the rotating blank 10 and the cutting ring 16 during the generation of a prolate optical surface which is shown in FIG. 4*a*. As shown in FIG. 4*b*, the plane of the axis of rotation 44 of cutting ring 16 is displaced from the plane of the axis of rotation 46 of the blank 10. Not only are the axes of the preform and the cutting tool angularly offset, but they are also in spaced-apart parallel planes.

FIG. 5 shows the dimensions and relationships between the blank 10 and cutting ring 16 during the generation of a preform of the type shown in FIG. 2. Tool 16 has an active grinding diameter D. The radius of the spherical surface on the blank 10 is denoted R, and the tool set angle is $\theta$. The relationship between tool set angle, radius of spherical surface and the active diameter of the cutting ring:

$$\sin\theta = D/2R$$

FIGS. 5*a* and 5*b* show exemplary dimensions and tool set angles for producing lenses of the type shown in FIG. 2. These are discussed further in the EXAMPLES.

FIG. 6 shows the cutting ring 16 in more detail. The cutting ring 16 is diamond grit impregnated in resin, for example, epoxy. The cutting ring 16 is mounted on a tool shank 48 with an epoxy bond 50. This configuration results in a resilient tool which aids in suppressing vibrations which may otherwise adversely effect the quality of the polish on the work.

EXAMPLES

The exemplary machine used to make preforms of the type shown in FIG. 2 had the following characteristics:

1. Feed System: A manual system consists of weights on cables preloading the linear air slide against a pivoting lever arm which is moved by a micrometer handwheel graduated in 0.0001" increments. The mechanical advantage of the lever arm allows axial movements of the work spindle of 0.00003" per division of the handwheel.

2. A high-pressure, oil and water-free, air supply was provided for the air spindles.

3. Spindle alignment in the vertical (Z) direction was achieved by using the following method:

First, a piece was ground, then blued with layout dye. Then, the tool was manually rotated against the piece with slight pressure and rub marks were observed. Precise spindle alignments were achieved when the tool swept a complete arc across the face of the workpiece. Height adjustment was made with adjusting wheel 32.

4. Tool design and coolant flow: Tool balance and trueness are necessary to keep cutting vibrations to a minimum. After mounting of tools to the air spindle, tools are trued by grinding with a metal bonded diamond tool mounted in the work spindle. (This can also be done on another machine.) The cutting face of the tool is generated to the work radius required and coolant grooves are machined in the face with a thin silicon carbide wheel mounted in a dental drill. The tool design is shown in FIG. 6. A low velocity, high volume coolant flow was acceptable after the tool grooves were added. The addition of a water soluble cutting fluid to the water also aided in the solution of the coolant problem. The cutting fluid, Monroe RI TM, is mixed at a 1:10 ratio.

5. A Blockhead® air bearing spindle was used for the work spindle, and a Westwind air bearing was used for the tool spindle.

PREFORM GRINDING—EXPERIMENT AND RESULTS

To evaluate the precision generator, a quantity of video lens preforms of the type shown in FIG. 2 were produced and compared with conventionally produced preforms in lens molding experiments. A lot of fifty preforms, each having a mass of 2.305g±.0133g, was processed using the precision generator of the present invention.

The following machine conditions were set up.

1. Spindle speeds:
   Tool spindle—90,000 rpm (Westwind)
   Work spindle—3200 rpm (Blockhead spindle)
2. Work feed: manual, 0.008"–0.010" per minute. Stock removal of 0.005"–0.006" with a 15 second sparkout at end of cut.
3. Coolant flow: —high velocity coolant jet.
4. Tooling: —⅛" diameter, 8–12 resin-bonded diamond with radiused, grooved cutting face.

The following table describes the parameters necessary to produce an acceptable video preform:

TABLE I

| | Side I (.370" R.) | Side II (.230" R.) |
|---|---|---|
| Tool Spindle Speed | 90,000 rpm | 90,000 rpm |
| Work Spindle Speed | 3,200 rpm | 3,200 rpm |
| Tool | FIG. 6 | FIG. 6 |
| Tool Setup | 26.0° | 40.75° |
| Work Feed Rate | .008"/min. | .005"/min. |
| Dwell | 15 seconds | 15 seconds |
| Tool Wear Compensation (infeed) | Negligible (none for 60 pieces) | .0001"/pc. |
| Machine Time/Piece | 2 min. | 3 min. |

Surface finish readings for all pieces average 0.2 microinches AA or less. Although not a requirement for lens preforms, it is noted that surface figures produced were two fringes or better as measured on a Zygo Interferometer. Some samples had readings of less than ¼ fringe. Radius control of Side I was excellent. Piece #1 was 0.3699", while piece #60 was 0.3700". No tool wear adjustments had to be made. Side II was noticeably more difficult to produce. Because of the sharper radius, more of the tool face is in contact with the work surface, making it more difficult to lubricate and cool the work tool interface properly. To compensate, the tool wall thickness is reduced. The tool spindle was adjusted 0.001" toward the work every tenth piece in order to maintain the required radius.

The generator setup requires that the OD of the lens, the diamond wheel diameter and the lens curve radius be known. From these parameters, the required tool set angle $\theta$ can be calculated by the formula:

$$\sin\theta = D/2R$$

where D is active diameter of the tool and R is required radius of the lens. This setup is shown schematically in FIG. 5. A major concern for this generator is the amount of the wheel that can be allowed to go over the edge of the lens. As a general rule, allow ⅓ of the wheel diameter to go over the edge of the lens. The condition then allows for wheel cooling and removal of the grinding swarf. It also allows more space for coolant to be picked up. The importance of this was demonstrated where Side I of the lens preform is much easier to do and shows less wheel wear than Side II. FIGS. 5*a* and 5*b* show schematically the setup for the first and second surfaces.

The preferred generator setup should be kept in mind during lens design. A lens in which R is much larger than D/2 is much easier to do than one in which R approaches D/2.

Inspection results of these preforms show Side II to be not as good as Side I, but still acceptable. Lens molding experiments show that these preforms to be at least equivalent to or slightly better than conventionally produced preforms. The mean scatter ratio of precision generated preforms is about 1.8% versus 2.5% for conventionally finished ware.

While a particular embodiment of the invention has been shown and described, various modifications are within the true spirit and scope of the invention. The appended claims are, therefore, intended to cover all such modifications.

What is claimed is:

1. A method of grinding and simultaneously polishing an optical surface on a glass blank for an optical lens comprising:

rotating said glass blank on an air bearing work spindle;

rotating a cutting ring on an air bearing tool spindle, the axis of said tool spindle being positioned at an angle with respect to the axis of said work spindle, and the active diameter of said cutting ring being substantially centered on the axis of rotation of said blank;

mounting said work spindle and said tool spindle on a common support;

moving one of said spindles linearly with respect to the other to move said cutting ring into engagement with said blank;

urging said one spindle under a constant force toward the other spindle for providing a feeding relationship between said cutting ring and said glass blank;

mounting drive means remote from said common support for permitting the linear movement of said one spindle under said constant force at a desired feed rate for grinding a precisely shaped, polished optical surface on said blank; and isolating said spindles from the vibration of said drive means.

2. The method recited in claim 1 including the step of mounting a resilient resin bonded diamond cutting ring on said tool spindle.

3. The method recited in claim 1 further comprising:

changing the plane of the axis of rotation of said work spindle with respect to the plane of the axis of rotation of said tool spindle to change the shape of said optical surface.

4. The method recited in claim 1 including the step of mounting the axis of rotation of the work spindle in a plane which is parallel to and displaced from the plane of the axis of rotation of said tool spindle to generate a prolate optical surface on said glass blank.

5. A machine for grinding and simultaneously polishing an optical surface on a glass blank for an optical lens comprising:

an air bearing work spindle for rotating said glass blank;

a cutting ring;

an air bearing tool spindle for rotating said cutting ring, the axis of said tool spindle being positioned at an angle with respect to the axis of said work spindle, and the active cutting diameter of said cutting ring being substantially centered on the axis of rotation of said blank;

a work table;

said work spindle and said tool spindle being mounted on said work table;

means for moving one of said spindles linearly with respect to the other for moving said cutting ring into feeding engagement with said blank;

said means for linearly moving one of said spindles includes means for biasing said one spindle under a constant load into feeding relationship with respect to the other, and motor means mounted remotely from said work table to isolate said spindles from the vibration of said motor means, and for allowing said one spindle biased under said constant load to move at a desired feed rate with respect to said other spindle for grinding a precisely shaped, polished optical surface thereon.

6. A machine for grinding and simultaneously polishing an optical surface on a glass blank as defined in claim 5, wherein said means for moving one of said spindles comprises:

a drive motor mounted remote from said work table;

linear drive means coupling said drive motor to said air bearing work spindle;

an arm;

said work spindle being biased against said arm;

said linear drive means includes means for moving said arm toward said tool spindle;

a micrometer drive coupled by a belt to said motor; and said micrometer drive permitting the movement of said arm linearly toward said tool spindle under the constant load biasing said work spindle against said arm.

7. A method of generating an optical quality polished surface which comprises:

providing a resilient grinding tool having diamond grit impregnated in resin about an annulus;

rotating said grinding tool about a first axis by means of a first air bearing spindle;

rotating a glass work piece about a second axis by means of a second air bearing spindle;

setting said first and second axes at an angle with respect to each other such that said grinding annulus passes substantially centrally of said rotating work piece;

urging said grinding tool and said work piece into relative contact with each other under a constant force;

moving said work piece into contact with said grinding tool at a desired feed rate by means of an air slide and a remotely mounted drive motor means for controlling the feed rate without inducing vibration to said spindles; and maintaining said work piece in contact with said grinding tool by means of said constant force for generating an optical quality polished surface on said work piece.

8. A method of generating an optical quality surface as defined in claim 7 including the step of positioning the first and second axes in spaced-apart parallel planes.

9. A method of generating an optical quality surface as defined in claim 7 including the step of setting the angle of said first and second axes with respect to each other in accordance with the formula:

$$\sin\theta = D/2R$$

wherein $\theta$ equals the angle between said first and second axes, D is the active cutting diameter of the tool annulus, and R is the desired radius of the optical quality surface to be generated.

* * * * *

UNITED STATES PATENT AND TRADEMARK OFFICE

CERTIFICATE OF CORRECTION

PATENT NO. : 4,760,672

DATED : August 2, 1988

INVENTOR(S) : Darcangelo et al.

It is certified that error appears in the above-identified patent and that said Letters Patent is hereby corrected as shown below:

Column 5, line 22, " 1/8" " should read -- 3/8" --.

Signed and Sealed this

Third Day of January, 1989

*Attest:*

DONALD J. QUIGG

*Attesting Officer*

*Commissioner of Patents and Trademarks*